US005909195A

United States Patent [19]

Merenda

[11] Patent Number: 5,909,195

[45] **Date of Patent: *Jun. 1, 1999**

[54] ANTENNAS EMPLOYING U-DIPOLE ELEMENTS

[75] Inventor: Joseph T. Merenda, Northport, N.Y.

[73] Assignee: Marconi Aerospace Systems Inc., Greenlawn, N.Y.

[ * ] Notice: This patent is subject to a terminal disclaimer.

[21] Appl. No.: 08/803,659

[22] Filed: Feb. 21, 1997

[51] Int. Cl.[6] ..... H01Q 21/12

[52] U.S. Cl. ..... 343/815

[58] Field of Search ..... 343/700 MS, 825, 343/828, 821, 814, 795, 702, 815

[56] References Cited

U.S. PATENT DOCUMENTS

| | | | |
|---|---|---|---|
| 4,800,393 | 1/1989 | Edward et al. | 343/821 |
| 5,406,295 | 4/1995 | Barinski et al. | 343/713 |
| 5,451,971 | 9/1995 | Grossman et al. | 343/828 |
| 5,526,003 | 6/1996 | Ogawa et al. | 343/713 |
| 5,532,708 | 7/1996 | Krenz et al. | 343/795 |
| 5,724,051 | 3/1998 | Mailandt et al. | 343/795 |

*Primary Examiner*—Don Wong
*Assistant Examiner*—Hoang Nguyen
*Attorney, Agent, or Firm*—Edward A. Onders; Kenneth P. Robinson

[57] ABSTRACT

A low cost array antenna (10) employs U-dipole elements (30) inserted into slots in a printed circuit board (18). Board (18), supported in spaced relation directly by back reflector (12), bears a feed network (22) connected to an input/output port (24). The dipole element (30) is a dual-dipole single-feed element, including parallel coextensive dipole segments (32, 34) attached at one end, with a sole signal feed path via feed segment (36). Feed segment (36) is inserted into board (18) and soldered to a feed point of feed network (22). One or more mounting tabs (38) are also inserted into slots in board (18) and may be fixed in place by soldering to an isolated conductor portion provided on board (18) for this purpose. A dual array antenna (50) includes dipoles (51–54) for left slant polarization reception and dipoles (61–64) for right slant polarization reception. Receive diversity is thus provided for cellular communications, with vertical polarization for transmission via parallel use of both arrays (51–54, 61–64).

24 Claims, 2 Drawing Sheets

ANTENNAS EMPLOYING U-DIPOLE ELEMENTS

BACKGROUND OF THE INVENTION

This invention relates to antennas and, more particularly, to economical forms of antennas employing U-dipole radiating elements of unitary sheet metal construction.

For a variety of reasons it is desirable to provide highly reliable, low cost antennas suitable for meeting the requirements of cellular communication applications. Prior types of antennas suitable for such applications have typically required a significant number of components, some of which may involve costly fabrication techniques, and involve relatively complex and expensive construction and assembly.

A new type of radiating element of U-dipole form, which is capable of fabrication by one piece stamping from conductive sheet stock, is disclosed and described in copending application Ser. No. 08/803,658, filed Feb. 21, 1997, titled U-Dipole Radiating Elements and Antennas and commonly assigned with the present application. The U-dipole form of radiating element provides the potential for use in new forms of antennas providing advantages of simplicity of construction and low cost fabrication.

Objects of the present invention are to provide new and improved antennas utilizing U-dipole elements and such antennas having one or more of the following characteristics or features:

- plug-in construction with U-dipole elements inserted into a printed circuit board;
- electrical connection by soldering U-dipole element feed segments to a feed network on a printed circuit board;
- U-dipole element structural support by insertion into a printed circuit board;
- feed network/structural printed circuit board supported directly by back reflector;
- U-dipoles supported by a printed circuit board in single or dual array configuration;
- array polarization determined by slant alignment of U-dipoles in an array; and
- diplexer arrangements for configurations such as 45 degree polarization for signal reception and vertical polarization for signal transmission.

SUMMARY OF THE INVENTION

In accordance with the invention, an antenna, including an array of U-dipole elements, includes a metallic back reflector and a printed circuit board mounted in spaced parallel relation to the back reflector. The circuit board bears a feed network to couple signals between an input/output port and feed points contiguous to mounting holes piercing the board. The antenna also includes a plurality of U-dipole elements each cut in one piece from a conductive sheet and including first and second dipole segments in nominally coextensive alignment parallel to the back reflector. The dipole segments are interconnected at one end, with the first dipole segment having a single attached feed segment inserted into one of the mounting holes and connected to a contiguous feed point, and the second dipole segment conductively connected only to the first dipole segment at such one end. The feed segment of each U-dipole element is typically soldered to a contiguous feed point to provide a sole signal feed path to each respective U-dipole radiating element from the feed network. The printed circuit board may additionally bear a plurality of isolated conductive portions separate from the feed network, with a mounting tab of the first dipole segment of each U-dipole element soldered to one of the isolated conductive portions to provide structural integrity.

Also in accordance with the invention, an antenna, including a dual array of U-dipole elements, includes a metallic back reflector and a printed circuit board mounted in spaced parallel relation to the back reflector. The circuit board bears a first feed network to couple signals between a first input/output port and a first plurality of feed points contiguous to mounting holes piercing the board, and a second feed network to couple signals between a second input/output port and a second plurality of feed points contiguous to mounting holes piercing the board. The antenna also includes a plurality of U-dipole elements each cut in one piece from a conductive sheet and including first and second dipole segments in nominally coextensive alignment parallel to the back reflector. The dipole segments are interconnected at one end, with the first dipole segment having a single attached feed segment inserted into one of the mounting holes and connected to a contiguous feed point and the second dipole segment conductively connected only to the first dipole segment at such one end. With this configuration, the plurality of U-dipole elements can be arranged with a first group of U-dipole elements each having a first angular alignment and connected to a respective feed point of the first feed network and a second group of U-dipole elements each having a second angular alignment and connected to a respective feed point of the second feed network.

The preceding dual array configuration may additionally include diplexer means arranged to provide (i) signal reception with polarization rotated nominally 45 degrees left of vertical, via the first input/output port, (ii) signal reception with polarization rotated nominally 45degrees right of vertical, via the second input/output port, and (iii) signal transmission with vertical polarization, via both the first and second input/output ports utilized in parallel.

For a better understanding of the invention, together with other and further objects, reference is made to the accompanying drawings and the scope of the invention will be pointed out in the accompanying claims.

DESCRIPTION OF THE INVENTION

Figure 1:
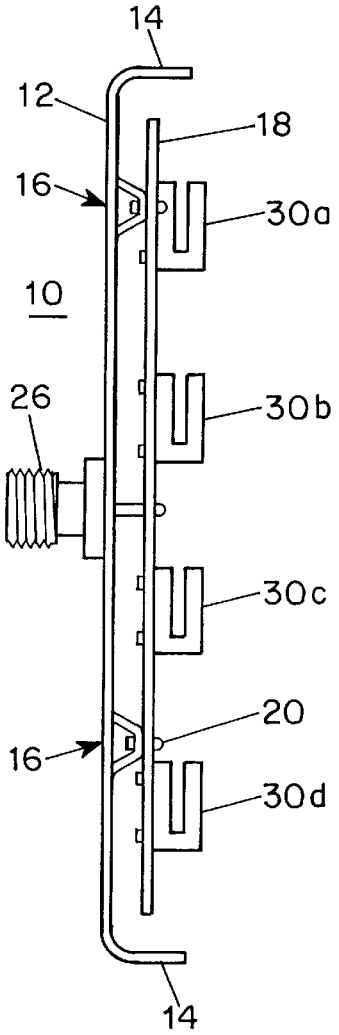
FIG. 1 is a side view of an antenna in accordance with the invention.
Figure 2:
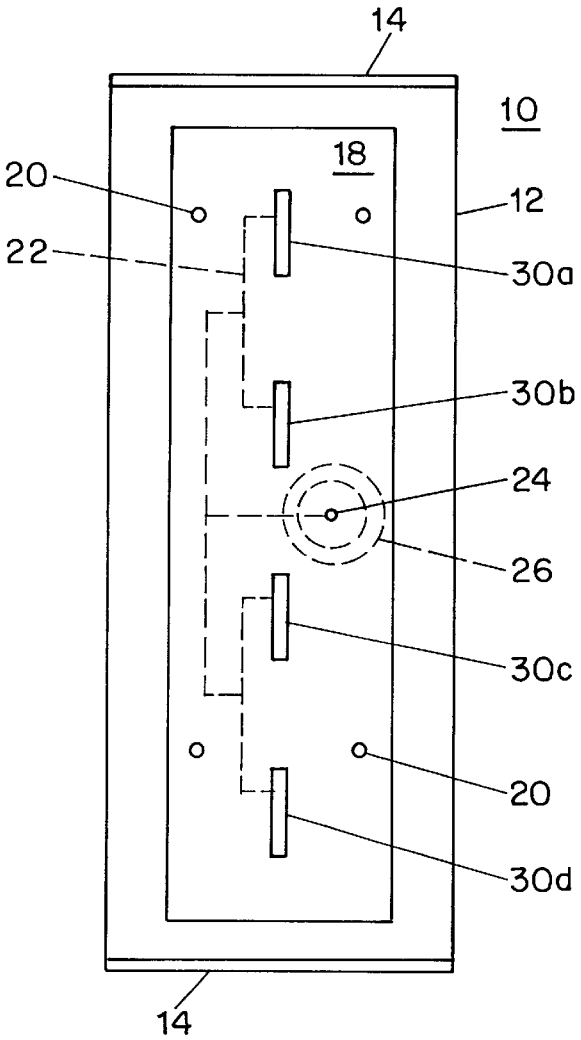
FIG. 2 is a front view of the FIG. 1 antenna.

With reference to the side and front views of FIGS. 1 and 2, there is illustrated an antenna 10 constructed in accordance with the invention and including an array of U-dipole elements. As shown, antenna 10 includes a reflective back reflector 12 of generally planar form with raised upper and lower edges. Back reflector 12 may be fabricated of aluminum or other suitable construction providing a reflective front surface. For ease of illustration, back reflector 12 is shown as including only upper and lower raised edges 12, but in specific applications may typically include raised edges on top, bottom and sides, edges bent back rather than forward as shown, or have a planar form lacking edges displaced forward or back. As illustrated, back reflector 12 may be fabricated with forward protrusions or dimples 16 suitable for supporting a printed circuit board in spaced relation to the front surface of reflector 12, as will be further discussed.

As shown, the antenna 10 also includes a printed circuit board 18 spaced in front of back reflector 12. In this example, a suitable pattern of dimples 16 protrude forward from back reflector 12 and board 18 is attached to such dimples by appropriate fasteners, such as rivets 20. Board 18 may typically be a single-sided printed circuit board bearing a conductor pattern on its planar surface not visible in FIG. 2 (which may be termed its "bottom" surface, even though the board will typically be aligned vertically, as shown, when the antenna is in use). As represented in dashed schematic form in FIG. 2, the conductor pattern comprises a feed network 22, to couple signals between an input/output port 24 and feed points contiguous to U-dipole mounting locations on board 18. As shown, input/output port 24 is represented as the center conductor of a coaxial connector assembly 26 extending from the back of reflector 12 to provide access for signal feed to and from the antenna. As represented, a suitable center conductor extension of connector 26 may extend through a hole in board 18 and be soldered or other wise electrically connected to the feed network conductor pattern on the bottom surface of board 18. In the illustrated embodiment, feed network 22 provides a parallel feed from input/output port 24.

Figure 3:
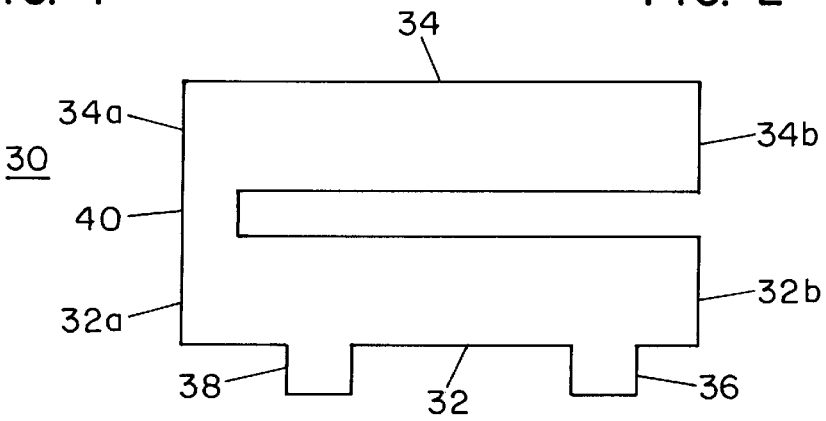
FIG. 3 shows an example of a planar type of U-dipole element as may be stamped from brass sheet stock.

Antenna 10 of FIGS. 1 and 2 further includes a plurality of U-dipole elements 30*a*–30*d* mounted on printed circuit board 18 at mounting locations to which individual feed points of the feed network 22 are contiguous, as illustrated in FIG. 2. A U-dipole is a type of radiating element which is disclosed and described in the above-referenced application Ser. No. 08/803,658, which is hereby incorporated herein by reference. As illustrated in FIG. 3, a U-dipole element 30 is a dual-dipole, single-feed radiating element which may be stamped in simple planar form from a sheet of brass stock or other suitable conductive material. As shown in FIG. 3, the U-dipole element 30 includes three primary segments 32, 34 and 36 and may include one or more mounting tabs 38, described as follows.

(a) A first linear conductor segment 32, in the form of a first dipole segment which, when mounted as in FIGS. 1 and 2, is spaced from and nominally parallel to back reflector 16.

(b) A second linear conductor segment 34, in the form of a second dipole segment is spaced from and nominally parallel to and coextensive with the first segment 32. As shown, second dipole segment 34 has one end 34*a* connected to a first end 32*a* of first segment 32 to form a U configuration. The second dipole segment 32 is thus conductively connected only to the first dipole segment at the respective first ends 32*a* and 34*a*, as shown in FIG. 3, via a short bridge segment 40.

(c) A feed conductor segment 36 is connected at a point along first dipole segment 32 which is spaced from the first end 32*a*. Typically, feed segment 36 will extend from first segment 32 at a point relatively close to its second end 32*b*, as illustrated. In the assembled antenna of FIGS. 1 and 2, the feed segment 36 is inserted into a hole piercing board 18 at a mounting position and connected to a contiguous feed point of the feed network 22. As thus connected, by soldering or other appropriate means, the feed segment 36 provides the sole signal feed path to couple signals to or from the U-dipole element.

(d) A mounting tab 38, or a plurality thereof depending on the particular structural design, protrudes from first segment 32. In the completed antenna of FIGS. 1 and 2, the mounting tab 38 is inserted into a suitably positioned hole piercing board 18 at a point isolated from the conductive pattern of the feed network 22 (i.e., the mounting tab 38 is not connected to any feed point of the feed network 22). In a currently preferred embodiment, printed circuit board 18 additionally bears a plurality of isolated conductive portions which are separate and isolated from feed network 22 and are adjacent to holes in the board 18 provided to receive the mounting tabs of respective U-dipole elements.

With this configuration, a U-dipole is mounted on board 18 by having its feed segment 36 inserted into a hole and soldered to a contiguous feed point to provide mechanical connection and electrical connection to the feed network 22, and by concurrently having its mounting tab 38 inserted into a hole and soldered to an adjacent isolated conductive portion. The mounting tab is thus mechanically and electrically connected to the isolated conductive portion, however such conductive portion is electrically isolated from and not connected to the feed network 22.

U-dipoles are further described and typical dimensions of such elements are provided in the above-referenced copending application. Referring now to FIGS. 1 and 2, it will be seen that with the inclusion of U-dipole elements 30*a*–30*d* (each of which has the form of element 30 of FIG. 3 in this embodiment) a linear array antenna is provided with parallel feed via feed network 22 and input and input signal access provided via rear-mounted connector 26. As shown in FIG. 3, segments 32 and 34 are coextensive, in that they are the same length and the ends 34*a* and 34*b* of second segment 34 are respectively aligned with the first and second ends 32*a* and 32*b* of first segment 32. It will be appreciated that while segments 32 and 34 will typically be coextensive and be positioned parallel to each other and to reflector 12, in some embodiments particular considerations may result in departures from strict length equality and parallel alignment. For this purpose, "nominally" is defined as being within plus or minus twenty percent of a stated condition or relationship, in order to cover elements which are not exactly coextensive, for example, but which are nominally coextensive.

With appropriate provision of materials and assembly techniques by skilled persons, a reliable and sturdy form of antenna is provided and may be economically fabricated and assembled from relatively simple and low cost components. For example, board 18 may be a relatively simple single-sided (i.e., conductive pattern on one side only and not fabricated to microwave transmission line standards) printed circuit board of rigid material typically about 0.30 inches thick, or may be of a more expensive configuration, if appropriate to meet operational specifications in a particular application. With an understanding of the invention, skilled persons will be capable of designing antennas in accordance with the invention for application and operation in a variety of cellular and other communication systems and uses.

Figure 4:
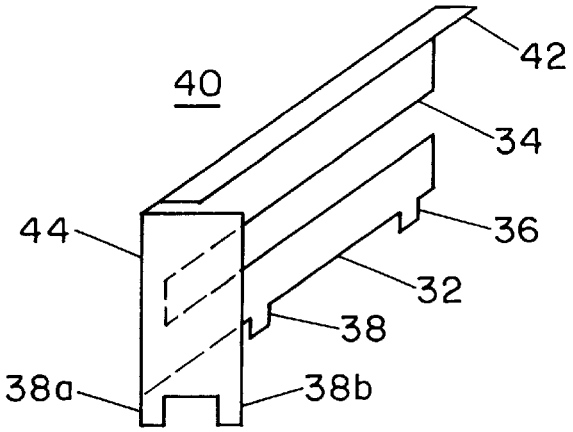
FIG. 4 is an orthographic view of a structurally stiffened form of U-dipole element suitable for inclusion in antennas utilizing the invention.

Referring now to FIG. 4, there is shown an alternative stiffened form of U-dipole element 40 providing increased structural stability when employed in antennas in accordance with the invention. In FIG. 4, the basic effective electrical configuration of the U-dipole element remains unchanged from that shown in FIG. 3. Structural elements added in FIG. 4 include an edge 42 bent normal to dipole segment 34 and end portion 44 bent normal to the connected ends of dipole segments 32 and 34, as shown. In FIG. 4, as illustrated, additional mounting tabs 38*a* and 38*b* are provided for insertion into additional holes in board 18. U-dipole element 40 may be stamped in planar form from a sheet of conductive material, with edge 42 and end portion 44 then bent to respective positions normal to the plane of the dipole segments 32 and 34. Electrical performance of U-dipole element 40 will be similar to that of element 30 and any effects resulting from the presence of edge and end portions 42 and 44 can be accommodated in the design process. With use of the FIG. 4 or other U-dipole element configurations, antennas with increased structural stability, resistance to vibration and shock, etc., can be provided.

Figure 5:
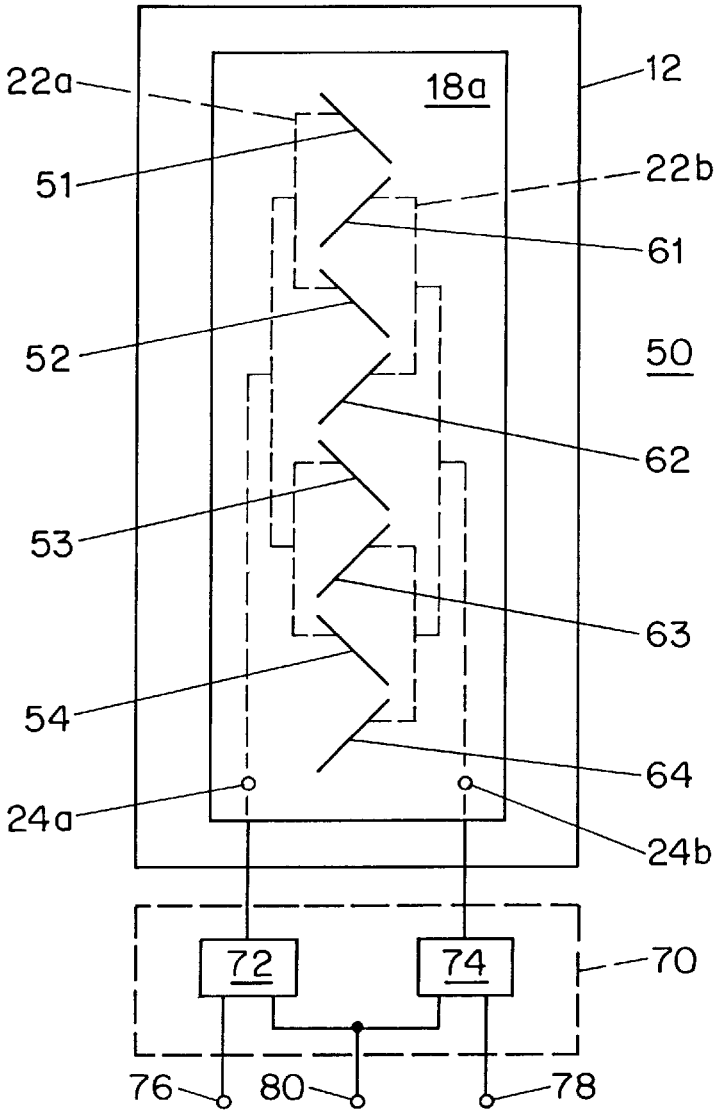
FIG. 5 is a front view of a dual array antenna in accordance with the invention, which is configured for reception with polarizations rotated left and right 45 degrees and transmission with vertical polarization.

FIG. 5 illustrates an antenna 50 in accordance with the invention, which employs a dual array of U-dipole elements.

A first group of U-dipole elements 51, 52, 53, 54 forms a first linear array. A second group of U-dipole elements 61, 62, 63, 64, which is interleaved as shown with the first group, forms a second linear array. As shown, each of elements 51–54 is positioned at a 45 degree left slant so as to operate with a polarization rotated 45 degrees left of vertical. Elements 61–64 are positioned at a 45 degree right slant to operate with a polarization rotated 45 degrees right of vertical. The dipole elements are mounted on a printed circuit board 18*a* which bears on its bottom surface a first feed network 22*a* connected to a first input/output port 24*a* and a second feed network 22*b* connected to a second input/output port 24*b*. Dipole element groups 51–54 and 61–64 are thus respectively coupled to input/output ports 24*a* and 24*b*. The FIG. 5 antenna also includes a diplexer unit 70 coupled to the ports 24*a* and 24*b*. As shown, diplexer unit 70 includes two three-pole diplexers 72 and 74, each of which may typically provide about 15 dB isolation between its terminals and may be provided as a discrete component or be printed wholly or partially on printed circuit board 18*a*. As shown, diplexer 72 is connected to the first port 24*a* and provides terminal 76 for access to the first array of dipoles 51–54. Similarly, diplexer 74 is connected to second port 24*b* and provides second array access via terminal 78. The remaining poles of diplexers 72 and 74 are commonly connected to terminal 80. With an understanding of the invention, skilled persons can provide diplexer unit 70 in a variety of forms suitable for different implementations. This arrangement, as shown in FIG. 5, enables provision of a low cost tri-function antenna, whereby receive diversity is provided for cellular or other applications. Thus, for diversity operation a left slant 45 degree polarization characteristic may be provided for signal reception via dipoles 51–54 and right slant 45 degree polarization characteristic is provided via dipoles 61–64. For signal transmission, a vertical polarization characteristic is provided by activation of all of the dipoles via terminal 80. Various arrangements pursuant to the invention may be provided by skilled persons using interleaved arrays along a common axis as illustrated or other configurations, and employing dipole elements of the types shown in FIGS. 3 and 4, or other types of radiating elements.

While there have been described the currently preferred embodiments of the invention, those skilled in the art will recognize that other and further modifications may be made without departing from the invention and it is intended to claim all modifications and variations as fall within the scope of the invention.

What is claimed is:

1. An antenna, including an array of U-dipole elements, comprising:

a back reflector;

a printed circuit board spaced in front of said reflector and bearing a feed network to couple signals between an input/output port and feed points contiguous to U-dipole element mounting locations on said board; and a plurality of U-dipole elements mounted at said mounting locations, each said U-dipole element including:

a first linear conductor segment spaced from and nominally parallel to said back reflector;

a second linear conductor segment spaced from and nominally parallel to and coextensive with said first segment, said second segment having one end connected to a first end of said first segment to form a U configuration; and a feed conductor segment connected at a point along said first segment spaced from said first end thereof, said feed segment connected to one of said contiguous feed points to provide a sole signal feed path to said U-dipole element.

2. An antenna as in claim 1, wherein said printed circuit board includes said feed network on one surface thereof and the feed conductor segment of each said U-dipole element is inserted in an opening piercing said board and connected to a contiguous feed point of said feed network.

3. An antenna as in claim 1, wherein each said U-dipole element is cut in one piece from a sheet of conductive material and the feed conductor segment thereof is inserted into an opening in said printed circuit board and connected to a contiguous feed point.

4. An antenna as in claim 3, wherein said feed conductor segment of each U-dipole element is soldered to a contiguous feed point to provide said sole signal feed path to each said U-dipole element.

5. An antenna as in claim 1, wherein each said U-dipole element is cut in one piece from a sheet of conductive material and additionally includes a mounting tab protruding from said first segment in spaced relation to said feed segment, and both said mounting tab and said feed segment are inserted into openings in said board, with said mounting tab not connected to any feed point.

6. An antenna as in claim 5, wherein said feed segment is soldered to a feed point, and said printed circuit board additionally includes on its surface an isolated conductive portion separate from said feed network, with said mounting tab soldered to said isolated conductive portion.

7. An antenna, including an array of U-dipole elements, comprising:

a metallic back reflector;

a printed circuit board mounted in spaced parallel relation to said back reflector, said circuit board bearing a feed network to couple signals between an input/output port and feed points contiguous to mounting holes piercing said board; and a plurality of U-dipole elements each cut in one piece from a conductive sheet and including first and second dipole segments in nominally coextensive alignment parallel to said back reflector and interconnected at one end, said first dipole segment having a single attached feed segment inserted into one of said mounting holes and connected to a contiguous feed point, and said second dipole segment conductively connected only to said first dipole segment at said one end.

8. An antenna as in claim 7, wherein each said U-dipole element comprises a planar portion of said conductive sheet including said first and second dipole segments, and additionally comprises at least one portion bent at an angle to said planar portion and providing increased rigidity.

9. An antenna as in claim 7, wherein said feed segment of each U-dipole element is soldered to a contiguous feed point to provide a sole signal feed to each respective U-dipole radiating element from said feed network.

10. An antenna as in claim 7, wherein said first dipole segment of each U-dipole element additionally includes at least one mounting tab inserted into a mounting hole in said printed circuit board, said mounting tab not connected to any feed point.

11. An antenna as in claim 10, wherein each said U-dipole element has a sole feed segment soldered to a contiguous feed point, and said printed circuit board additionally bears on said one side a plurality of isolated conductive portions separate from said feed network, with the mounting tab of the first dipole segment of each said U-dipole element soldered to one of said isolated conductive portions.

12. An antenna, including a dual array of U-dipole elements, comprising:

a metallic back reflector;

a printed circuit board mounted in spaced parallel relation to said back reflector, said circuit board bearing a first feed network to couple signals between a first input/output port and a first plurality of feed points contiguous to mounting holes piercing said board and a second feed network to couple signals between a second input/output port and a second plurality of feed points contiguous to mounting holes piercing said board; and a plurality of U-dipole elements each cut in one piece from a conductive sheet and including first and second dipole segments in nominally coextensive alignment parallel to said back reflector and interconnected at one end, said first dipole segment having a single attached feed segment inserted into one of said mounting holes and connected to a contiguous feed point, and said second dipole segment conductively connected only to said first dipole segment at said one end;

said plurality of U-dipole elements including a first group of U-dipole elements, each having a first angular alignment and connected to a respective feed point of said first feed network, and a second group of U-dipole elements, each having a second angular alignment and connected to a respective feed point of said second feed network.

13. An antenna as in claim 12, wherein each of said first and second groups of U-dipole elements is aligned in a linear array.

14. An antenna as in claim 12, wherein each of said first and second groups of U-dipole elements is aligned in a linear array along a common line.

15. An antenna as in claim 12, wherein when said back reflector is aligned nominally vertically, each of the U-dipole elements of said first group is aligned with a nominally 45 degrees left rotation relative to vertical and each of the U-dipole elements of said second group is aligned with a nominally 45 degrees right rotation relative to vertical.

16. An antenna as in claim 15, additionally including a diplexer unit coupled to said first and second input/output ports and arranged to provide (i) signal reception with linear polarization rotated nominally 45 degrees left of vertical, via said first input/output port, (ii) signal reception with linear polarization rotated nominally 45 degrees right of vertical, via said second input/output port, and (iii) signal transmission with vertical polarization, via both said first and second input/output ports in parallel.

17. An antenna as in claim 16, wherein each of said first and second groups of U-dipole elements is aligned in a linear array along a common line.

18. An antenna as in claim 12, wherein said printed circuit board is a single-sided board, bearing conductors on only a single side thereof.

19. An antenna as in claim 12, wherein said first dipole segment of each said U-dipole element additionally includes at least one mounting tab inserted into a mounting hole in said printed circuit board, said mounting tab not connected to any feed point of a feed network.

20. An antenna, including a dual array of dipole elements, comprising:

a metallic back reflector;

a first linear array of dipole elements, each aligned to operate with linear polarization rotated nominally 45 degrees left of vertical;

a first feed network coupling each dipole element of said first array to a first input/output port;

a second linear array of dipole elements, each aligned to operate with linear polarization rotated nominally 45 degrees right of vertical;

a second feed network coupling each dipole element of said second array to a second input/output port; and a diplexer unit coupled to said first and second input/output ports and arranged to provide access to at least one of said first linear array, said second linear array, and both of said linear arrays in parallel.

21. An antenna as in claim 20, wherein each dipole element is a U-dipole element.

22. An antenna as in claim 20, wherein each said feed network provides a parallel feed from an input/output port to an array of dipole elements.

23. An antenna as in claim 20, wherein said first and second linear arrays comprise dipole elements positioned along a common vertical axis.

24. An antenna as in claim 20, wherein said diplexer unit provides access to each of said first linear array, said second linear array and both of said linear arrays in parallel, to enable signal reception via each of said first and second linear arrays and signal transmission with vertical polarization via both linear arrays in parallel.

* * * * *